US006193262B1

(12) United States Patent
Silva

(10) Patent No.: US 6,193,262 B1
(45) Date of Patent: Feb. 27, 2001

(54) INTERFACE DEVICE BETWEEN A BOOT AND ALPINE SKI

(75) Inventor: Gilles Silva, Chef Lieu (FR)

(73) Assignee: Salomon S.A., Metz-Tessy (FR)

( * ) Notice: Subject to any disclaimer, the term of this patent is extended or adjusted under 35 U.S.C. 154(b) by 0 days.

(21) Appl. No.: 09/086,340

(22) Filed: May 29, 1998

(30) Foreign Application Priority Data

May 30, 1997 (FR) ..... 97 06841

(51) Int. Cl.[7] ..... A63C 5/07
(52) U.S. Cl. ..... 280/607; 280/602
(58) Field of Search ..... 280/602, 607, 280/609, 617, 618, 634, 636, 14.2; 441/70

(56) References Cited

U.S. PATENT DOCUMENTS

| | | | | |
|---|---|---|---|---|
| 4,896,895 | | 1/1990 | Bettosini | 280/607 |
| 5,332,252 | | 7/1994 | Le Masson et al. | 280/602 |
| 5,344,176 | * | 9/1994 | Trimble | 280/602 |
| 5,441,296 | | 8/1995 | Phelipon et al. | 280/602 |
| 5,464,242 | | 11/1995 | Commier et al. | 280/602 |
| 5,465,994 | | 11/1995 | Commier et al. | 280/602 |
| 5,470,094 | | 11/1995 | Commier et al. | 280/602 |
| 5,480,175 | | 1/1996 | Astier et al. | 280/607 |
| 5,492,356 | | 2/1996 | Astier et al. | 280/602 |
| 5,597,170 | | 1/1997 | Le Masson et al. | 280/602 |
| 5,785,342 | * | 7/1998 | Bronson | 280/607 |
| 5,845,923 | * | 12/1998 | Zanco | 280/602 |

FOREIGN PATENT DOCUMENTS

| | | | | |
|---|---|---|---|---|
| 4030214 | * | 4/1991 | (DE) | 280/607 |
| 4402662 | | 8/1995 | (DE) . | |
| 270175 | * | 6/1988 | (EP) | 280/14.2 |
| 398794 | * | 11/1990 | (EP) | 280/14.2 |
| 490824 | * | 6/1992 | (EP) | 280/607 |
| 506064 | * | 9/1992 | (EP) | 280/607 |
| 0510308 | | 10/1992 | (EP) . | |
| 564767 | * | 10/1993 | (EP) | 280/602 |
| 0599041 | | 6/1994 | (EP) . | |
| 602350 | * | 6/1994 | (EP) | 280/607 |
| 0623370 | | 11/1994 | (EP) . | |
| 2695041 | | 3/1994 | (FR) . | |
| WO83/03360 | | 10/1983 | (WO) . | |
| 93/16769 | * | 9/1993 | (WO) | 280/607 |
| WO95/07737 | | 3/1995 | (WO) . | |

* cited by examiner

*Primary Examiner*—J. J. Swann
*Assistant Examiner*—Frank Vanaman
(74) *Attorney, Agent, or Firm*—Greenblum & Bernstein, P.L.C.

(57) ABSTRACT

An interface device between a boot and a ski including a front platform and a rear platform. The front and rear platforms have adjacent ends located near one another between the mounting zones of the front and rear retention elements, wherein at least one of the platforms is mounted to be floating along a longitudinal direction with respect to a median stud provided to be affixed to the ski, with an adjacent end provided to rest in simple support against the stud, in a direction that tends to distance it from the other platform, an opposing end being free to slide along a longitudinal direction, and an abutment to be affixed to the ski just beyond the opposing end at a predetermined distance so as to limit the free sliding thereof during bending of the ski.

24 Claims, 5 Drawing Sheets

LG
LP
JP
JG
45
39
40a
41
36
40
35
38
42
46

64
66
62
54
58
55a
60
56
55
59
57
53
61
63
65

INTERFACE DEVICE BETWEEN A BOOT AND ALPINE SKI

BACKGROUND OF THE INVENTION

1. Field of the Invention

The invention is related to an interface device between a boot and an alpine ski. The invention is also related to a retention assembly for a boot on a ski having such an assembly, as well as to a ski equipped with such a retention assembly.

2. Description of Background and Relevant Information

Skis have been known to be equipped with an interface device between the boot and the boot retention elements in order to modify the bending characteristics of the ski.

For example, international patent application published as WO 83/03360 discloses a plate that is raised with respect to the upper surface of the ski. The plate bears the two boot retention elements. One of its ends is fixedly connected to the ski, whereas the other end is free, and blocks of elastically deformable material offer a progressive resistance to its displacement during the bending of the ski.

This device provides good results. However, although the influence that it exerts on the ski varies in intensity with the bending of the ski, the type of influence remains the same. In other words, the device stiffens certain zones of the ski in a variable manner, but does not change the zone of the ski on which it has an impact in accordance with the bending of the ski. In addition, when the ski bends very substantially, the plate has a tendency to arch.

In addition, the patent application published as No. EP 623 370 discloses an interface device of the same type where the front end of the plate cooperates with an abutment fixed on the ski in accordance with the various types of operations that occur successively with the bending of the ski. Although the adjustment of this device is delicate, the device provides good results; however, the various zones of the ski where it successively exerts its impact are not the best adapted zones.

Furthermore, in these known devices, the reaction to the thrust of the rear retention element is recovered by the plate in such a way that it is always insulated from the ski.

Finally, the patent application published as No. EP 599 041 discloses a device where both retention elements are mounted on separate supports. The rear element is mounted on a plate whose rear end has limited gliding freedom with respect to an abutment that is integral with the ski, and where the front end of the plate extends in front of the front support and takes support against it when a return thrust is exerted thereupon. When the ski bends, the return thrust is returned towards the front support as long as the rear end of the plate is free to slide.

This device also provides good results, but the ski zones impacted by its action have not been optimized. Also, it does not function very progressively.

SUMMARY OF THE INVENTION

It is an object of the present invention to improve upon the performance of this type of interface, i.e., to suggest an improved device which, on the one hand, optimizes the ski zones whose mechanical characteristics are modified during the bending of the ski and, on the other hand, whose functioning method works progressively with the bending of the ski.

Other objects and advantages of the invention will emerge from the description that follows.

The interface device according to the invention comprises a rear platform with a raised mounting zone for a rear retention element, a front end and a rear end, and a front platform having a mounting zone for a front retention element, a front end and a rear end. The front and rear platforms have adjacent ends that are located in each other's vicinity between the mounting zones of the front and rear retention elements, wherein at least one of the platforms is mounted to be floating along a longitudinal direction with respect to a median stud provided to be affixed to the ski, with one adjacent end provided to rest in simple support against the stud, in a direction that tends to distance it from the other platform, an opposite end being free to slide along a longitudinal direction, and an abutment provided to be affixed to the ski just beyond the opposite end at a predetermined distance so as to limit its free sliding during the bending of the ski.

According to a first embodiment, only one of the platforms, for example, the front platform, is mounted to be floating with respect to the median stud. Preferably, according to this embodiment, the median stud is affixed to the rear platform, the rear platform having a front end that is fixedly connected to the ski, and its rear end being free to slide.

In this way, when the ski lies flat, the forces generated by the return reaction are returned beneath the boot, almost in the axis of the skier's leg. As a result, the ski is freer and can get deformed more easily. The ski adapts better to the terrain, glides better, takes turns more easily and is more tolerant.

In cases of little or moderate bending, since the forces are returned in a localized manner beneath the boot, the forces are progressively transmitted partially towards the opposite end by the elastic abutment. The device allows a better control of the stiffening of the front and rear portions of the ski, at the front and at the rear of this point. In case of substantial bending, the front end of the front platform comes into abutment, the forces generated by the return reaction thus being transmitted to the ski in their entirety, and the ski continues to bend beneath the boot by pushing back the rear retention element.

With respect to a conventional stiffener having a plate, the central zone of the ski beneath the boot is stiffer during small and moderate amounts of bending, and it becomes less stiff when the bending is greater.

According to another embodiment of the invention, both platforms are mounted to be floating.

BRIEF DESCRIPTION OF THE DRAWINGS

The invention will be better understood with reference to the following description and the annexed drawings that form an integral part thereof, in which.

DETAILED DESCRIPTION OF THE INVENTION

Figure 1:
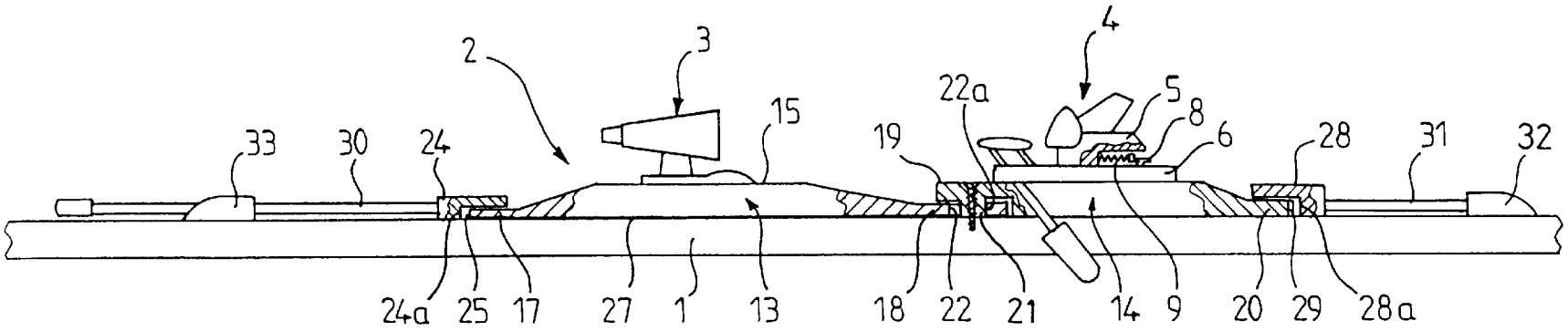
FIG. 1 is a side and partial sectional view of the device according to a first, non-limiting embodiment of the invention.

FIG. 1 is a side view of the main part 1 of a ski, overhung with the interface device 2, and two front and rear retention elements 3 and 4.

The retention elements are of any appropriate type provided for a standard boot and will not be described in detail. In a known manner, so as to ensure the pinching of the boot, the rear retention element has a body 5 that is slidably mounted along a slide 6. A latch 8 determines the initial position of the body of the element, and a spring 9, commonly known as a return spring, elastically resists the rearward movement of the body.

The retention elements 3 and 4 are fixedly assembled respectively to a front platform 13 and a rear platform 14 of the interface device 2.

Figure 2:
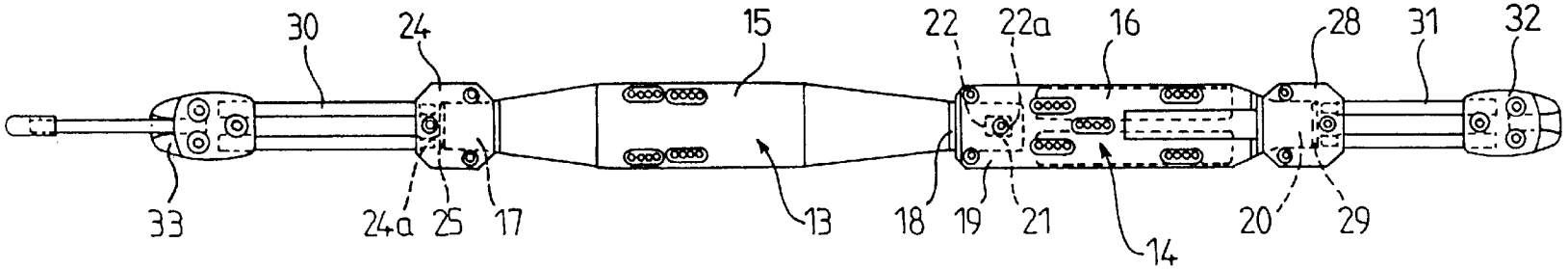
FIG. 2 represents the device of FIG. 1 in a top view.

FIG. 2 shows that in its upper part, the front platform 13 has a mounting zone 15 for the front retention element 3, and a mounting zone 16 for the rear retention element 4. The front and rear mounting zones are raised with respect to the upper surface of the ski. In the embodiment illustrated, each of the mounting zones has a series of offset openings that allow the retention elements to be assembled according to a variable spacing, and, if necessary, a variable longitudinal position on the ski.

The two front and rear platforms 13 and 14 each have a front end and a rear end, respectively 17 and 18, for the front platform 13, and 19 and 20 for the rear platform 14. The adjacent front and rear ends 18 and 19 are located near one another towards the center of the central portion of the ski, i.e., between the mounting zones 15 and 16. The other ends 17 and 20 will be known hereafter as the opposing ends.

According to the embodiment of the invention shown in FIGS. 1 and 2, the front platform 13 is mounted to be floating along the longitudinal direction defined by the ski.

A median stud 21 is affixed to the ski towards the adjacent ends 18 and 19. The stud 21 is located between the front and rear mounting zones. It is also located in the extension of the tibial axis of the skier. At this level, the end 18 of the platform 13 has a slot 22 that the stud 21 crosses. The slot 22 and the stud 21 cooperate together so as to allow the free sliding of the end 18 of the front platform 13 along a longitudinal direction. Movements along other directions are hindered.

Towards the rear end 18 of the platform 13, the slot 22 also has a support surface 22*a* provided to rest in simple support against the stud 21 during the frontward displacement of the front platform 13, i.e., in the direction that tends to distance it from the rear platform 14.

At the front, the end 17 of platform 13 is a parallelepiped joining piece that is guided into the opening of a cap 24 which is fixedly connected to the ski. The opening of the cap 24 has a base wall 24*a*. Preferably, a block of elastically deformable material 25 is placed between the joining piece or front end 17 and the base 24*a*.

The assembly is provided in such a way that when the ski lies flat in the presence of a boot, the joining piece or front end 17 is applied without any pressure against the block 25. In fact, it is the return thrust transmitted by the boot that biases the front platform 13 frontwardly. The front platform is retained by the support of the wall 22*a* of the slot against the stud 21. During small or moderate bending of the ski, the joining piece 17 compresses the block 25. The slot 22 remains in support against the stud 21. For this, the stiffness of the block 25 is less than the stiffness of the return. During substantial bending, the block 25 reaches its maximum compression, and the wall 24*a* then functions like a straightforward abutment. The rear end 18 of the platform 13 leaves its support against the stud 21. The return of the rear retention element 4 constantly compensates the displacement of the heel of the boot, regardless of the amount of bending.

The front platform 13 is preferably constructed in an extremely rigid manner, with generally the same materials as a ski, but it could also be obtained from reinforced polyamide. In its median portion, it has substantially the same width as the upper surface of the ski and a thickness that is equal to the thickness of the rear platform 14 (close to one centimeter). At the front of front platform 13, the functional clearance between the joining piece 17 and the cap 24 allows only a longitudinal movement for the front platform 13, and sideways movements, such as torsional movements, are restricted for the front platform 13.

Preferably, a thin layer 27 of shock absorbing material is located between the platform 13 and the upper surface of the ski. In addition, the bottom of the platform 13 has at least one longitudinal groove filled with a type of viscoelastic putty that gets pressed against the upper surface of the ski during the assembly of the platform. This allows the absorption of the vibrations of the ski and the movements of the platform.

The rear platform 14 has a front end 19 fixedly connected to the ski, for example, via screws. Advantageously, as can be seen from the drawings, the stud 21 is a part of the rear platform 14. In the stud zone, the rear platform 14 has a longitudinal recess that acts as a guide for the end 19. Advantageously, except for the slot 22, the end 18 is a joining piece of the same shape as the joining piece 17, and the recess of the front end 1*a* of rear platform 14 is of the same type as the recess of the cap 24, with the exception of the stud 21.

The rear end 20 of the platform 14 is free to slide longitudinally in the opening of a cap 28 fixedly connected to the ski. A block of elastically compressible material 29 is preferably placed between the end 20 and the base wall 28*a* of the cap 28 opening. The assembly is provided in such a way that when the ski is flat, the end 20 is applied without any pressure against the block 29. During the bending of the ski, the end 20 compresses the block 29.

Preferably, as is the case for the front platform 13, a thin layer of shock absorbing material and at least one longitudinal strip of a viscoelastic type putty are located between the platform and the ski.

Figure 3:
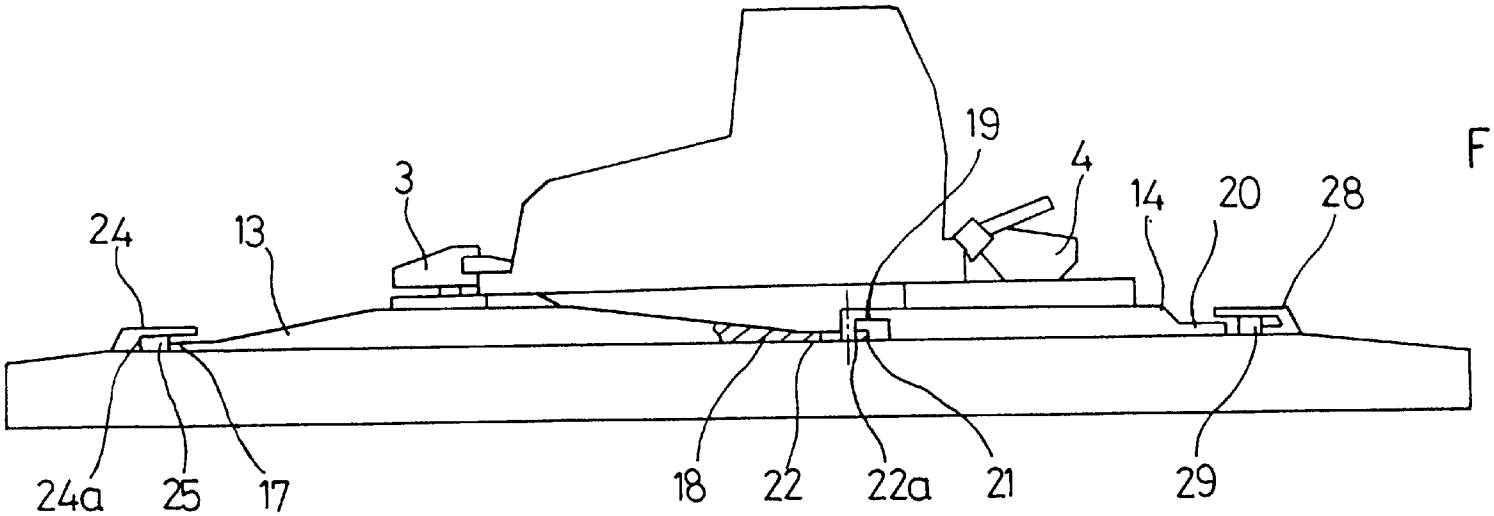
FIG. 3 is a schematic side view of the main parts of the device depicting an operational mode.

With reference to FIG. 3, in the presence of the boot and the flat ski, the thrust of the return spring is transmitted by the boot to the front platform 13. The front platform 13 is held by the stud 21. Its front end is applied without any pressure against the block 25.

During small or moderate bending of the ski, the opposing end 20 of the platform 14 gets displaced and causes a progressive compression of the block 29. The opposing end 17 of the platform 13 compresses the block 25 in the same way, which progressively transmits the return reaction to the front cap 24. The adjacent end 18 of the platform 13 is however kept in contact with the stud 21 by the thrust of the return spring 9.

The front and rear platforms 13, 14 act as stiffeners for the front and rear parts of the central zone of the ski in the bending phase only. But when the ski is flat, the reactional forces to the return thrust are returned to the stud zone 21 located beneath the boot. The ski can be deformed more easily from its resting position, and adapts better to the deformations of the terrain, is easier to manage in turns, and is also more tolerant. During bending, the rear platform 14 stiffens the rear part of the central zone of the ski. This helps in stabilizing the ski.

By compressing the block 25, the front platform 13 also contributes to stabilizing the front portion of the ski.

Figure 4:
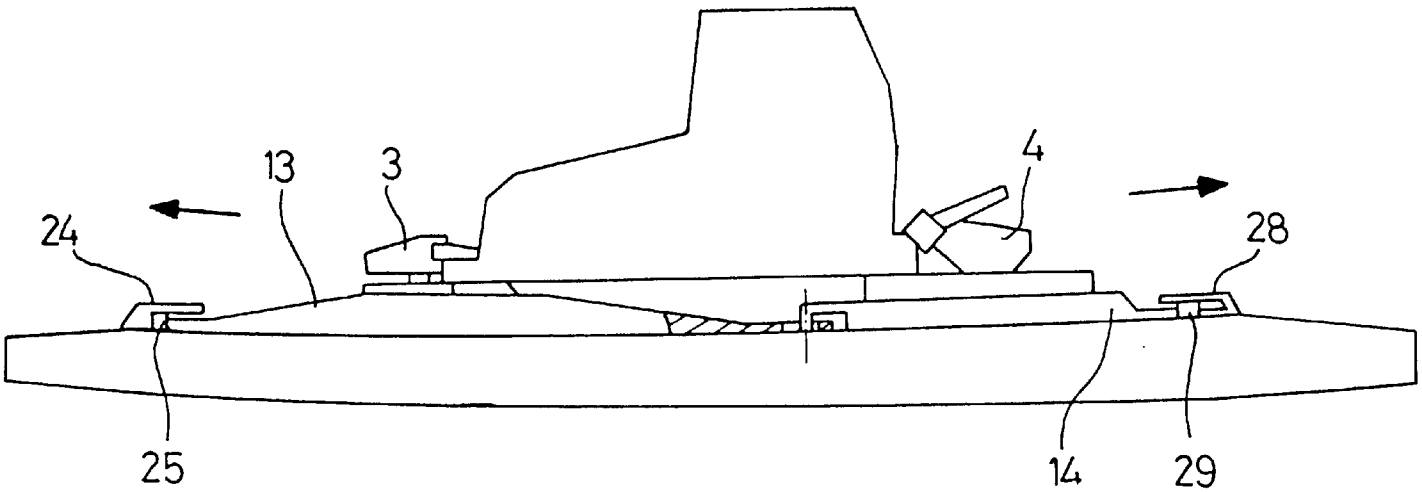
FIG. 4 is a schematic side view of the main parts of the device that depicts movement of the device.

With reference to FIG. 4, in cases where the ski bends substantially, the rear platform 14 continues to function as described previously. Towards the front, the block 25 reaches its maximum compression, and the cap 24 thus behaves like an abutment that resists the forward movement of the front platform 13. If the ski continues to bend, the rear end of the platform 13 leaves its support against the stud 21. The two platforms 13, 14 are no longer coupled together. The rear retention element 4 constantly slides towards the rear, against the return force of the return spring 9. The reaction to this thrust is thus transmitted entirely to the ski over the entire length of the interface. The two platforms 13, 14 no longer have a direct connection along a longitudinal direction.

With respect to a conventional plate stiffener, the stiffening that they produce on the ski is partially attenuated by the return of the rear retention element 4. Indeed, during substantial bending, that device does not have a long plate that could cause it to get arched.

Advantageously, in the assembly described and according to the hardness of the elastic abutments selected, the instant interface is stiffer than a plate interface for small to moderate bending of the ski. It is less stiff than a plate interface during strong bending of the ski, regardless of the hardness of the elastic abutments 25, 29.

FIGS. 1 and 2 show the interface device 2 extended frontwardly and rearwardly via regulating arms, respectively 30, 31. Such arms are known and do not constitute an integral part of the invention. They each have a fixed end embedded in each of the caps 24, 28, and respectively frontwardly and rearwardly, a mobile end that is guided into a cap 33, 32 belonging to each of them, the displacement being controlled by a layer of viscoelastic material that is biased during shearing. The effect of these arms is to dampen and stabilize the front and rear ends of the ski. This effect is in addition to the action of the interface device 2.

Figure 5:
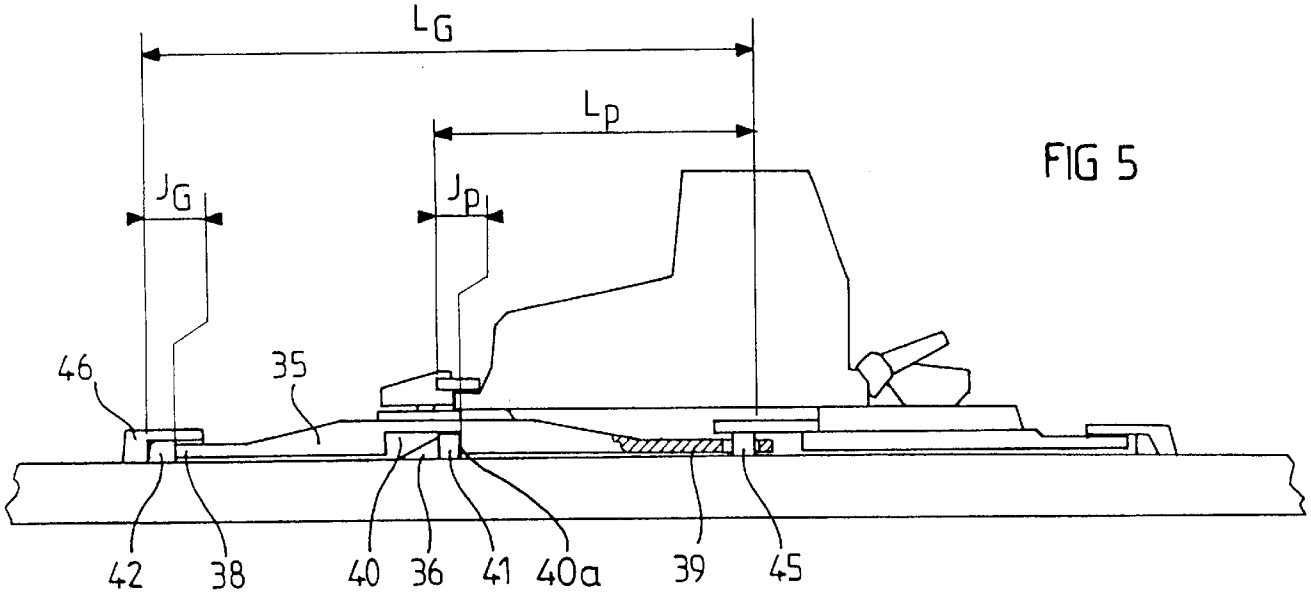
FIG. 5 schematically represents an alternative embodiment.

FIG. 5 illustrates an embodiment variation. An intermediate wedge 36 is placed beneath the front platform 35, approximately at mid distance between the front joining piece 38 and the rear end 39 that is adjacent to the other platform. At this level, the platform 35 has a counter abutment which is provided to cooperate with the intermediate wedge. For example, this can be the rear wall 40*a* of a recess 40 located at the lower part of the platform 35, in the abutment zone 36. A block of elastically deformable material 41 is located between such wall 40*a* and the intermediate wedge 36. The stiffness of this block of material is less than that of the spring 9, and its compression path is less than the distance provided in the formula:

$J_P < J_G \times L_P / L_G$ in which:

$J_P$ designates the distance between the intermediate wedge 36 and the counter abutment or rear wall 40*a* during rest, $J_G$ designates the distance, at rest, between the end 38 of the front platform 35 and the abutment 46, $L_P$ designates the distance between the intermediate wedge 36 and the stud 45, $L_G$ designates the distance between the wedge 46 and the stud 45.

This variation functions as follows. At rest, when the ski is flat, the front platform is applied without any pressure against the two blocks 41 and 42. The platform 35 is kept towards the front via the stud 45. When the ski bends slightly, under the effect of the thrust of the return spring 9, the front platform compresses the two blocks 41 and 42, and progressively transfers the return thrust mainly along the intermediate wedge 36 and a little bit along the front cap 46. In more substantial bending, the block 41 reaches its maximum compression, and the intermediate wedge 36 behaves like a straightforward abutment; the platform 35 transfers its support from the block 41 onto the abutment 36. For a bending having an even greater amplitude, the front joining piece 38 continues to compress the block 42. When this block reaches its maximum compression, it is the front cap 46 that behaves like a straightforward abutment. This therefore results in the lock of further compression of the block 41, which means that the return thrust gets transferred from the intermediate wedge 36 to the cap 46.

Thus, as the ski bends, the return thrust is transmitted to the ski in the zones extending from beneath the boot towards the front of the front retention element. In addition, when the ski bends very substantially, the stiffening effect of the platform remains limited because when the block 42 is at maximum compression, it is the return spring of the rear element that absorbs the bending of the ski.

It is to be understood that in the same way, two or even more intermediate abutments could be placed so as to obtain a progressive transfer of the return thrust as the ski bends.

In the embodiments described previously, it is the front platform that is floating, whereas the rear platform has an adjacent end that is fixedly connected to the ski. An inverse arrangement is also possible, i.e., the rear platform can be floating and the front platform can have an adjacent end that is fixedly connected to the ski.

Also in an alternative embodiment, the opposite end of the platform that is not floating could be fixedly connected to the ski.

Figure 6:
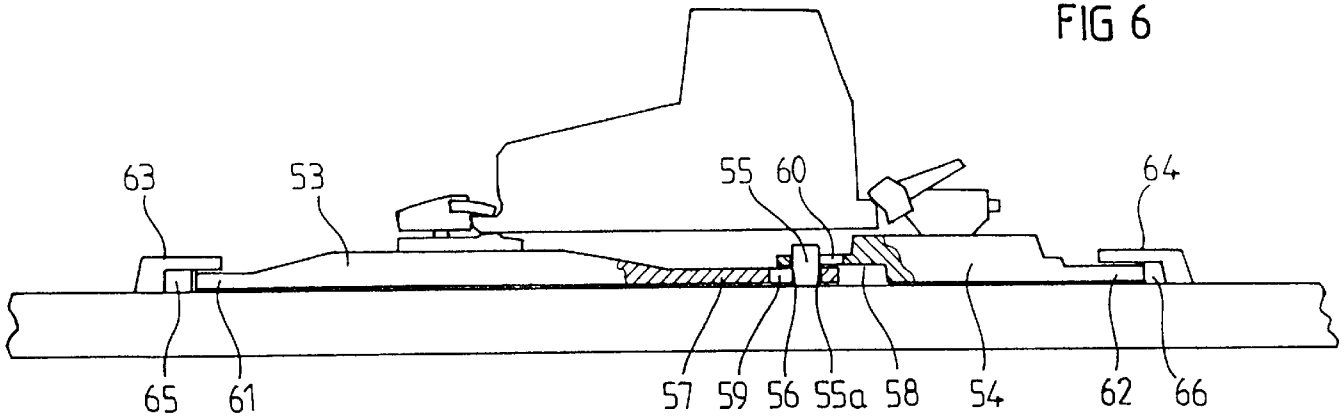
FIG. 6 is a schematic representation, in a side view, of another embodiment of the invention.

FIG. 6 shows another embodiment of the invention according to which both the front and rear platforms 53 and 54 are mounted to be floating with respect to a median stud 55. Here, the stud 55 is independent and it is affixed to the ski. At its adjacent end each platform has a slot 59, 60 that the stud 55 crosses, and whereby each of the platforms is retained in the direction that distances it from the other.

At their opposing ends 61, 62, the two platforms have a similar construction, with front and rear ends 61, 62 each engaged in a cap 63, 64, and a block of elastically compressible material 65, 66 inserted therebetween. The stiffness of the blocks and their compression path are provided such that the caps 63, 64 behave like straightforward abutments when the ski bends very substantially. The stiffness and the path of the two blocks can, however, be different.

At rest, when the ski is flat, the front and rear ends 61, 62 are applied without any pressure against the blocks 65 and 66. The return thrust is retransmitted to the median stud 55. During slight or moderate bending, the platforms compress the blocks 65 and 66, and this progressively transfers the return thrust towards the two caps 63 and 64. In a more substantial bending, either together or one after another, the platforms leave their support on the stud 55, and are kept in abutment against the caps 63 and 64. The bending of the ski thus causes the return of the rear retention element.

As in the previous case, a shock absorbing layer and one or several strips of putty can be placed between each of the platforms and the upper surface of the ski.

Figure 7:
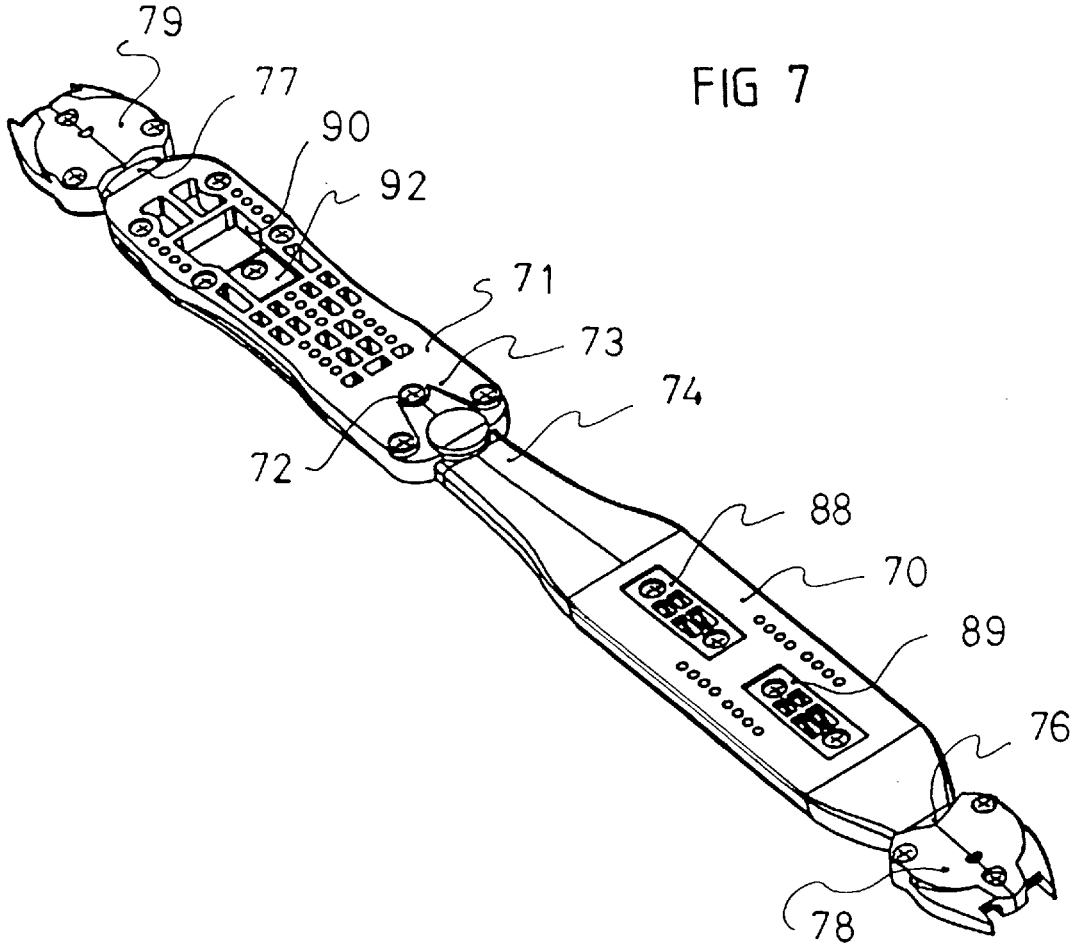
FIG. 7 is a perspective view of an interface device according to another embodiment of the invention.
Figure 8:
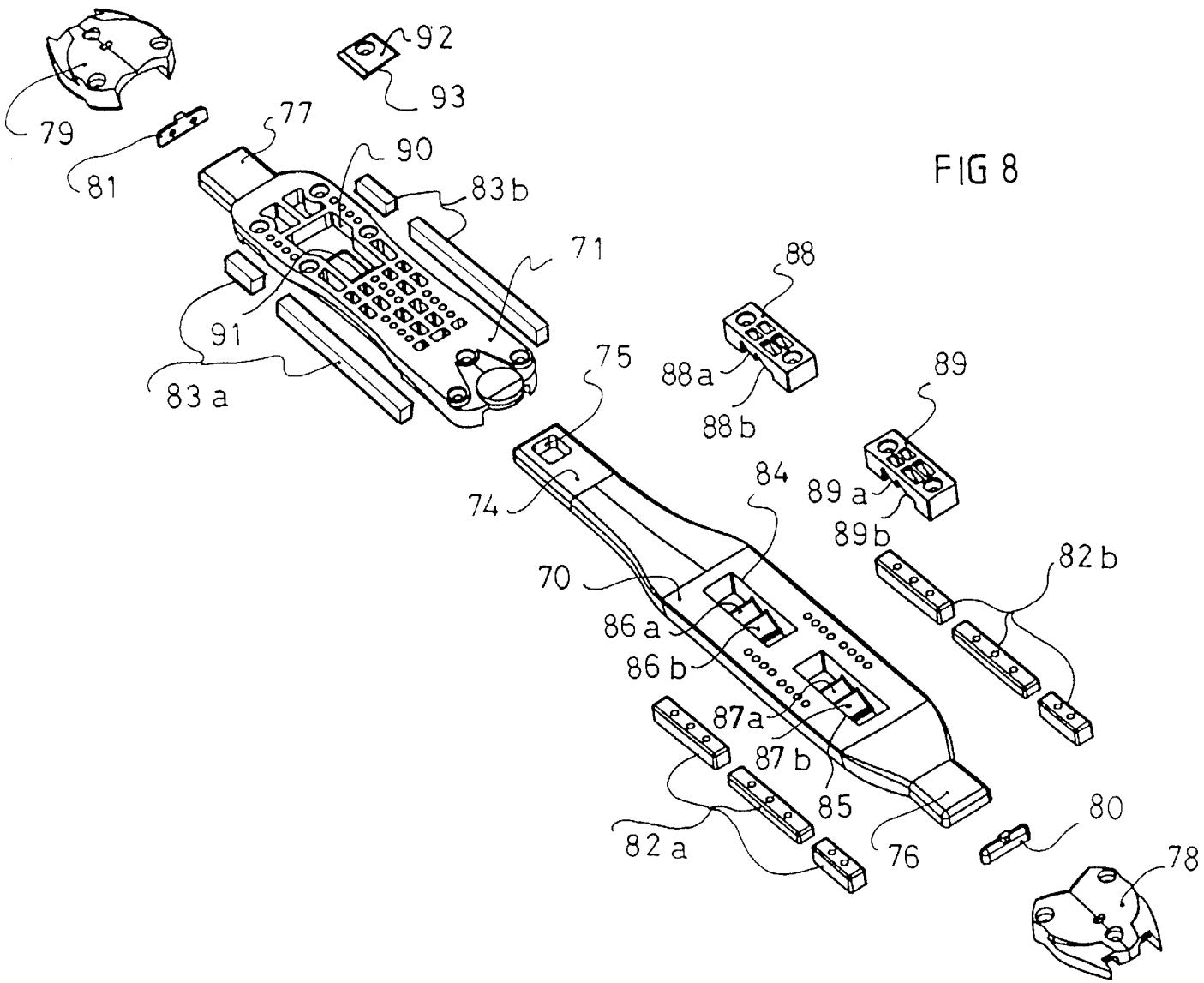
FIG. 8 represents an exploded view of the various elements of the previous drawing.

FIGS. 7 and 8 represent another embodiment of the invention according to which progressive intermediate wedges are placed over the length of the front and rear platforms.

The embodiment represented in these drawings has a front platform 70 and a rear platform 71. The front end 73 of the rear platform is fixedly connected to the ski, for example, via screws. The median stud constitutes an integral part of the end 73 of the platform. It is affixed to the ski via the central screw 72. The front platform 70 is floating. Its adjacent end 74 has a slot 75 which is crossed by the median stud. As in the previously described embodiments, the opposing ends 76 and 77 are free to slide inside the caps 78 and 79, their movement causing the compression of a block of elastically deformable material 80, 81, for example, an elastomer block.

The front and rear platforms 70, 71 are slightly raised with respect to the upper surface of the ski, except in the end zone 73 of the rear platform 71 which is affixed to the ski. In the raised zones, the platforms 70 and 71 rest on elastically compressible blocks 82*a*, 82*b* and 83*a*, 83*b*, that are, for example, partially embedded in housings located in the thickness of the platforms 70, 71. These blocks could be replaced by a punched layer or any other appropriate device.

In the shown embodiment, the front platform 70 has two recesses 84 and 85 that are distributed over the length of the platform. Each recess has two inclined ramps 86*a*, 86*b* for the recess 84 and 87*a*, 87*b* for the recess 85. Two snap-hooks/clamps 88 and 89, with complementary counter-ramps 88*a*, 88*b* and 89*a*, 89*b*, are engaged in the recesses. The snap-hooks/clamps 88, 89 are fixedly assembled to the ski by their ends. Advantageously, depending on the type of skiing being practiced, either one or the other, or both snap-hooks/clamps 88 and 89 are positioned in their respective recesses. The ramps are inclined from the top down and from the rear to the front. Their inclination is approximately 30 degrees with respect to the horizontal plane defined by the upper surface of the ski. The number of wedges and their inclinations have been provided only as non-limiting data.

Similarly, the rear platform 71 has a recess 90 with a ramp 91. A wedge 92 is introduced in the recess and affixed to the ski. The wedge has a counter ramp 93. The ramp and its counter ramp are inclined from the front to the rear and from the top down. As an example only, satisfactory results were obtained with an angle of inclination of 40 degrees.

The operational method is as follows. In the zone of the intermediate wedges, the platforms are slightly raised with respect to the ski via an elastically compressible material. When the ski bends, under the effect of the return thrust, the ramps progressively press the front platform against the ski and the longitudinal support of the front platform is progressively transferred from the median stud and the slot 75 towards the ramps of the snap hooks/clamps 88 and 89. When the platform is pressed to the maximum degree possible, the snap hooks/clamps behave like a straightforward abutment. If both snap hooks/clamps are present, as would be preferable, then they are slightly offset so that the total transfer occurs first over the rear snap hooks/clamps 88 and then over the front snap hooks/clamps 89.

In parallel to this movement, the front joining piece 76 slides beneath the cap 78 and compresses the block 80. In case of a very substantial bending of the ski, the block 80 reaches its maximum compression. The cap 78 thus behaves like a straightforward abutment, and the return thrust, which then increases significantly, is transferred in its entirety over the front cap 78.

In the case of the rear platform 71, the ramps cooperate in the same way in order to press the platform 71 against the ski. Since the front end 73 of the platform 71 is affixed to the ski, the ramps recover a portion of the longitudinal forces, but there is no transfer of support as was the case with the front platform 70; instead, support is applied to the rear end 77 because the rear platform 71 arches during the bending of the ski. This arrangement was adapted to increase acceleration upon exiting a curve.

This embodiment allows a progressive transfer of the return thrust reaction in the different zones of the ski, which becomes increasingly greater as the ski bends more and more. The pressing of the front and rear platforms 70, 71 against the ski ensures that when the ski bends, there is a progressive and mutual stiffening of the ski and the platforms. As such, it becomes possible to use less rigid and thus lighter platforms. This pressing also results in the improvement in the lateral connection between the platforms and the ski during bending, or in other words, the connection about the longitudinal axis defined by the ski. The skier's instructions are thus transmitted more directly to the ski.

In an alternative embodiment, the rear platform 71 could also be mounted so as to be floating, as was the case in FIG. 6, and it can be equipped with progressive intermediate wedges, such as those described for the front platform 70.

Inclined ramps for just one of the two platforms can also be envisioned.

The instant invention is not to be limited to the particulars of the alternative embodiments described herein, and other alternative embodiments always remain possible. In particular, the blocks of elastically deformable material could be removed, i.e., the transfer of the stud towards the caps could be achieved in an all or nothing manner, instead of being progressive. It would also be possible to reduce the thickness of the blocks so as to leave a slight clearance, at rest, between the end of the platforms and the caps.

What is claimed is:

1. An interface device between a boot and a ski comprising:

a front platform comprising a mounting zone for a front retention element, a front end, and a rear end;

a rear platform comprising a raised mounting zone for a rear retention element, a front end, and a rear end;

each of the front platform and the rear platform having an adjacent end disposed near one another between the mounting zones of the front and rear retention elements;

at least one of the front platform and the rear platform comprising a floating platform which is adapted to be mounted in a floating manner along a longitudinal direction with respect to a median stud affixed to the ski;

the adjacent end of one of the front and rear platforms being adapted to rest in simple support against the median stud, in a direction that tends to distance one platform from the other platform;

the floating platform comprising an opposing end which is adapted to be free to slide in a longitudinal direction with respect to the ski;

wherein the opposing end is adapted to cooperate with an abutment which is affixed to the ski so as to limit the free sliding of the floating platform during a bending of the ski.

2. The device of claim 1, further comprising a block of elastically deformable material disposed between the opposing end of the floating platform and the abutment for limiting a free sliding movement.

3. The device of claim 2, wherein a portion of the opposing end of the floating platform is slidably disposed within a recess of a cap adapted to be fixedly assembled to the ski, the abutment comprising a base of the cap recess.

4. The device of claim 3, wherein the adjacent end of the floating platform comprises a slot for engaging the median stud.

5. The device of claim 1, further comprising a shock-absorbing layer disposed adjacent a ski engaging lower surface of the floating platform.

6. The device of claim 1, wherein the floating platform comprises a ski engaging lower surface which is adapted to engage a shock absorbing material.

7. The device of claim 1, further comprising at least one intermediate wedge disposed between two ends of the floating platform.

8. The device of claim 7, wherein the front platform is the floating platform and wherein the abutment is adapted to cooperate with a counter abutment of the front platform, such that a distance, at rest, between the intermediate wedge and the counter abutment is less than a value $J_P$ given by a formula: $J_P<J_G \times L_p/L_G$, wherein $J_P$ designates the distance between the intermediate wedge and the counter abutment at rest, $J_G$ designates the distance between the front end of the front platform and the abutment at rest, $L_P$ designates the distance between the intermediate wedge and the median stud, and $L_G$ designates the distance between the abutment and the median stud.

9. The device of claim 1, wherein at least one of the front and rear platforms comprises an inclined ramp which is adapted to cooperate with a counter ramp affixed to the ski, whereby the counter ramp comprises one of at least one stop and at least one wedge, the inclined ramp being inclined so as to press at least one of the front and rear platforms against an upper surface of the ski when the ski bends.

10. The device of claim 1, wherein only one of the front and rear platforms is floating and the other platform comprises an adjacent end which is adapted to be fixedly connected to the ski.

11. The device of claim 1, each of the front and rear platforms are adapted to be mounted in a floating manner with respect to the median stud.

12. The device of claim 1, wherein the interface device is adapted to support the boot when the boot is disposed on the interface device so as to engage each of a front retention element and a rear retention element.

13. The device of claim 1, wherein the interface device is adapted to couple the boot of a user to the ski.

14. An interface device between a boot and a ski comprising:

a front platform comprising a mounting zone for a front boot retention element, a front end, and a rear end;

a rear platform comprising a raised mounting zone for a rear boot retention element, a front end, and a rear end;

the rear end of the front platform being disposed adjacent to and cooperating with the front end of the rear platform;

at least one of the rear end of the front platform and the front end of the rear platform comprising a slot for engaging a median stud affixed to the ski;

at least one of the front end of the front platform and the rear end of the rear platform being adapted to cooperate with an abutment which is affixed to the ski so as to limit the movement of one of the front platform and the rear platform.

15. The device of claim 14, wherein at least one of the front and rear platforms comprises at least one inclined ramp adapted to cooperate with at least one counter ramp affixed to the ski.

16. The device of claim 14, wherein at least one of the front and rear platforms comprises at least one inclined ramp adapted to cooperate with at least one counter ramp affixed to the ski, the at least one counter ramp comprising one of at least one stop and at least one wedge.

17. The device of claim 6, wherein the at least one inclined ramp is engageable with the at least one counter ramp so as to press at least one of the front and rear platforms against an upper surface of the ski when the ski bends.

18. The device of claim 14, wherein the front platform is adapted to be moveable in a longitudinal direction with respect to the ski and wherein the front end of the rear platform is adapted to be fixedly connected to the ski.

19. The device of claim 14, wherein each of the front and rear platforms are adapted to pivot about a center axis of the median stud.

20. The device of claim 14, further comprising at least two blocks of deformable material adapted to be disposed between one of the front platform and the ski and the rear platform and the ski.

21. The device of claim 14, wherein the front end of the front platform is adapted to slidably engage the abutment, the abutment being part of a front cap which is adapted to be fixedly assembled to the ski.

22. The device of claim 21, wherein the rear end of the rear platform is adapted to slidably engage the abutment, the abutment being part of a rear cap which is adapted to be fixedly assembled to the ski.

23. The device of claim 22, wherein the front end of the front platform is adapted to be moveably retained within a recess in the front cap, the recess comprising a block of deformable material.

24. The device of claim 22, wherein the rear end of the rear platform is adapted to be moveably retained within a recess in the rear cap, the recess comprising a block of deformable material.

* * * * *